US009318847B2

(12) United States Patent
Endo et al.

(10) Patent No.: US 9,318,847 B2
(45) Date of Patent: Apr. 19, 2016

(54) ELECTRIC CONNECTOR

(71) Applicant: DAI-ICHI SEIKO CO., LTD., Kyoto (JP)

(72) Inventors: Takayoshi Endo, Shizuoka (JP); Sakai Yagi, Shizouka (JP); Koji Hanaki, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/575,542

(22) Filed: Dec. 18, 2014

(65) Prior Publication Data

US 2015/0200492 A1 Jul. 16, 2015

(30) Foreign Application Priority Data

Jan. 10, 2014 (JP) ..... 2014-003681

(51) Int. Cl.

| | |
|---|---|
| ***H01R 13/514*** | (2006.01) |
| ***H01R 13/639*** | (2006.01) |
| ***H01R 13/436*** | (2006.01) |
| *H01R 4/18* | (2006.01) |
| *H01R 13/422* | (2006.01) |
| *H01R 13/627* | (2006.01) |

(52) U.S. Cl.

CPC ..... *H01R 13/639* (2013.01); *H01R 13/4361* (2013.01); *H01R 4/184* (2013.01); *H01R 13/4223* (2013.01); *H01R 13/6272* (2013.01)

(58) Field of Classification Search

CPC ..... H01R 13/4362; H01R 13/4361; H01R 13/4365; H01R 13/4368; H01R 13/4223

USPC ..... 439/752, 595, 345

See application file for complete search history.

(56) References Cited

U.S. PATENT DOCUMENTS

| | | | | | |
|---|---|---|---|---|---|
| 5,299,958 | A * | 4/1994 | Ohsumi | H01R 13/4362 | 439/752 |
| 5,378,176 | A * | 1/1995 | Sasai | H01R 13/4362 | 439/752 |
| 5,437,565 | A * | 8/1995 | Atsumi | H01R 13/4362 | 439/752 |
| 5,464,353 | A * | 11/1995 | Saijo | H01R 13/4362 | 439/188 |
| 5,478,262 | A * | 12/1995 | Yamanashi | H01R 13/4362 | 439/752 |
| 5,490,802 | A * | 2/1996 | Plyler | H01R 13/4368 | 439/752 |
| 5,516,308 | A * | 5/1996 | Yamanashi | H01R 13/4362 | 439/752 |
| 5,830,013 | A * | 11/1998 | Saito | H01R 13/4362 | 439/595 |
| 5,839,923 | A * | 11/1998 | Yoshida | H01R 13/4362 | 439/752 |

(Continued)

FOREIGN PATENT DOCUMENTS

| | | | |
|---|---|---|---|
| JP | H0397875 | 10/1991 | H01R 13/639 |
| JP | 08-50953 | 2/1996 | H01R 13/514 |
| JP | H1116625 | 1/1999 | H01R 13/42 |

*Primary Examiner* — Abdullah Riyami
*Assistant Examiner* — Vladimir Imas
(74) *Attorney, Agent, or Firm* — Hayes Soloway P.C.

(57) ABSTRACT

The electric connector includes a housing having cavities partitioned by partition walls, a terminal being inserted into each of the cavities, the housing being formed with at least one retainer insertion hole formed through a sidewall of the housing and the partition walls in a second direction perpendicular to a first direction in which the terminal is inserted into each of the cavities, and a retainer inserted into the retainer insertion hole to be engaged with the terminal in the housing, the retainer including a surface with which the retainer makes contact with the retainer insertion hole, and at least one projection formed on the surface, the projection passing over at least one partition wall and being engaged with a particular partition wall, the projection being elastically deformable in the first direction.

8 Claims, 16 Drawing Sheets

(56) References Cited

U.S. PATENT DOCUMENTS 6,010,374 A * 1/2000 Miwa ..... H01R 13/4362 439/752
6,152,783 A 11/2000 Tsuchiya ..... 439/752
6,322,391 B1 * 11/2001 Kodama ..... H01R 13/4223 439/595
7,390,228 B2 * 6/2008 Rimke ..... H01R 13/4223 439/595
8,727,816 B2 * 5/2014 Takahashi ..... H01R 13/4361 439/595
8,951,066 B2 * 2/2015 Glick ..... H01R 13/426 439/595

* cited by examiner

ELECTRIC CONNECTOR

BACKGROUND OF THE INVENTION

1. Field of the Invention

The invention relates to an electric connector used for electrical connection between devices equipped in an automobile, an industrial machine, and so on, and more specifically, to an electric connector including a retainer preventing a terminal from being released out of a housing into which the terminal was inserted. The invention relates further to a retainer used in the above-mentioned electric connector.

2. Description of the Related Art

An electric connector used for electrical connection between devices equipped in an automobile, for instance, is generally designed to include a double engagement structure for preventing a terminal from being released out of a housing after the terminal was inserted into the housing.

FIG. 10 is a perspective view of the electric connector suggested in Japanese Utility Model Application Publication No. H3(1991)-97875, and FIG. 11 is a cross-sectional view of the electric connector.

As illustrated in FIG. 10, a housing 40 includes a plurality of terminal spaces 41 into each of which a terminal 42 is inserted.

The housing 40 is formed at a sidewall thereof with three through-holes 43.

A retainer 44 includes a flat base 45, and three arms 46A, 46B and 46C extending from the base 44 in the same direction.

Each of the arms 46A, 46B and 46C is inserted into the through-hole 43 of the housing 40, and thus, as illustrated in FIG. 11, each of the arms 46A, 46B and 46C makes abutment with an engagement portion 47 of the terminal 42 in the housing 40 to thereby prevent the terminal 42 from being released out of the housing 40.

FIG. 12 is a cross-sectional view of the electric connector suggested in Japanese Patent Application Publication No. H11(1999)-16625, FIG. 13 is a partial cross-sectional view of the electric connector, and FIG. 14 is a perspective view of the retainer.

As illustrated in FIG. 12, a housing 60 includes a plurality of terminal spaces 61 into each of which a terminal 70 is inserted. The housing 60 is formed at a sidewall 62 thereof with a hole 63.

As illustrated in FIG. 14, a retainer 50 includes two flexible arms 53 each having an engagement projection 52 formed by making a cut-out 51 at a rear end thereof, and a hook 54 making abutment with the sidewall 62 of the housing 60.

As illustrated in FIG. 12, the retainer 50 is inserted into the hole 63 of the housing 60. Being inserted into the hole 63 of the housing 60, as illustrated in FIG. 13, the retainer 50 is engaged at the engagement projection 52 thereof with a projection 71 of the terminal 70. Thus, the terminal 70 is prevented from being released out of the housing 60.

The conventional electric connector illustrated in FIGS. 10 and 11 is accompanied with a problem that since the retainer 44 is simply inserted into the housing 40, the retainer 44 may be released out of the housing 40 if an external force acts on the retainer 44.

The conventional electric connector illustrated in FIGS. 12 to 14 is accompanied with a problem that since the retainer 50 has a complex configuration, a strength of the retainer 50 is lowered as the retainer 50 is down-sized, resulting in that the retainer 50 may be damaged when the retainer 50 is inserted into or pulled out of the housing 60.

SUMMARY OF THE INVENTION

In view of the above-mentioned problems in the conventional electric connectors, it is an object of the present invention to provide an electric connector capable of preventing a terminal from being released out of a housing without complexity in a configuration of a retainer used for preventing the terminal from being released out of the housing.

In one aspect of the present invention, there is provided an electric connector including a housing having a plurality of cavities partitioned by at least one partition wall, a terminal being inserted into each of the cavities, the housing being formed with at least one retainer insertion hole formed through a sidewall of the housing and the partition wall in a second direction perpendicular to a first direction in which the terminal is inserted into each of the cavities, and a retainer to be inserted into the retainer insertion hole to be engaged with the terminal in the housing, the retainer including a surface with which the retainer makes contact with the retainer insertion hole, and at least one projection formed on the surface, the projection passing over at least one partition wall and being engaged with a particular partition wall, the projection being elastically deformable in the first direction.

Since the projection is designed to be elastically deformable in the first direction, the projection passes over a target partition wall by elastically deforming, and then, is engaged with the target partition wall. In addition, the retainer inserted into the through-hole of the housing makes contact at the surface thereof with the through-hole in a broad area, and hence, even if an external force acts on a terminal to cause the terminal to be released out of the housing, the surface of the retainer receives the external force to thereby prevent the terminal from being released out of the housing.

It is preferable that the housing includes a plurality of partition walls, the partition wall or partition walls situated at a rear in the second direction relative to the partition wall with which the projection is engaged is (are) formed with a cut-out such that the partition wall or partition walls does (do) not block the projection passing through the retainer insertion hole when the retainer is inserted into the retainer insertion hole.

Since the projection passes by the cut-out, the retainer is able to smoothly pass through the through-hole.

It is preferable that the retainer is formed with a through-hole extending in a direction perpendicular to the first direction below the projection in the first direction, the through-hole allowing the projection to be elastically deformable.

The retainer is able to be elastically deformable by virtue of a simple structure of the second through-hole, and thus, allows the projection to pass over the partition wall(s) and to be engaged with a partition wall over which the projection finally overpassed.

In the case that the housing is formed with N retainer insertion holes, N indicating an integer equal to or greater than 2, the retainer may be designed to include a base, and N arms extending from the base in the same direction.

It is preferable that the projection has a width smaller than a width of the retainer in a direction perpendicular to the second direction.

It is preferable that the projection includes two surfaces inclining in the second direction. For instance, the projection may be designed to have a triangular or trapezoidal cross-section. As an alternative, the projection may be designed to have a semicircular cross-section.

It is preferable that the housing includes a plurality of partition walls, the projection being engaged with one of the partition walls situated centrally in the second direction or one of the partition walls situated in the vicinity of a center in the second direction.

The retainer is able to elastically deformable at the maximum at or in the vicinity of a center thereof. By designing the projection to be engaged with the partition wall situated centrally or in the vicinity of a center in the second direction, the retainer can be surely engaged with the partition wall.

It is preferable that the housing includes a plurality of partition walls, the projection being engaged, after passing over one partition wall, with the one partition wall.

The projection of the retainer is able to be engaged with a partition wall merely by passing over the partition wall.

It is preferable that the housing includes a plurality of partition walls, the projection being engaged, after passing over a plurality of partition walls, with a partition wall over which the projection finally passed.

Even if the projection returns back over the previous partition wall, the projection can be engaged with the adjacent partition wall.

In another aspect of the present invention, there is provided a retainer to be inserted into a housing having a plurality of cavities partitioned by at least one partition wall, a terminal being inserted into each of the cavities, the housing being formed with at least one retainer insertion hole formed through a sidewall of the housing and the partition wall in a second direction perpendicular to a first direction in which the terminal is inserted into each of the cavities, the retainer being inserted into the retainer insertion hole to be engaged with the terminal in the housing, the retainer including a surface with which the retainer makes contact with the retainer insertion hole, and at least one projection formed on the surface, the projection passing over at least one partition wall and being engaged with a particular partition wall, the projection being elastically deformable in the first direction.

The advantages obtained by the aforementioned present invention will be described hereinbelow.

The surface of the retainer at which the retainer and an inner surface of the through-hole make contact with each other is able to cancel a force by which a terminal inserted into the housing is caused to be pulled out of the housing. Thus, the electric connector in accordance with the present invention is capable of preventing a terminal from being released out of a housing without complexity in a configuration of a retainer.

By designing a partition wall to have a cut-out such that the partition wall does not block the projection passing through the through-hole when the retainer is inserted into the through-hole, the retainer is able to smoothly pass through the through-hole.

By designing the retainer to be formed with a second through-hole extending in a direction perpendicular to the first direction below the projection in the first direction, the retainer is able to be elastically deformable by virtue of a simple structure of the second through-hole, and thus, the projection can pass over the partition wall(s) and be engaged with a partition wall over which the projection finally overpassed.

By designing the projection to be engaged with a partition wall situated centrally in the second direction or a partition wall situated in the vicinity of a center in the second direction, the retainer can be designed to be centrally or almost centrally deformable, ensuring enhancement in a strength of the retainer.

By designing the projection to be engaged, after passing over one partition wall, with the one partition wall, the retainer can be readily inserted into the housing.

By designing the projection to be engaged, after passing over a plurality of partition walls, with a partition wall over which the projection finally passed, even if the projection returns back over the previous partition wall, the projection can be engaged with the adjacent partition wall, in which case, since the retainer is in a condition of extending outwardly over the housing, it is readily seen that the retainer returned back over the previous partition wall.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1A:
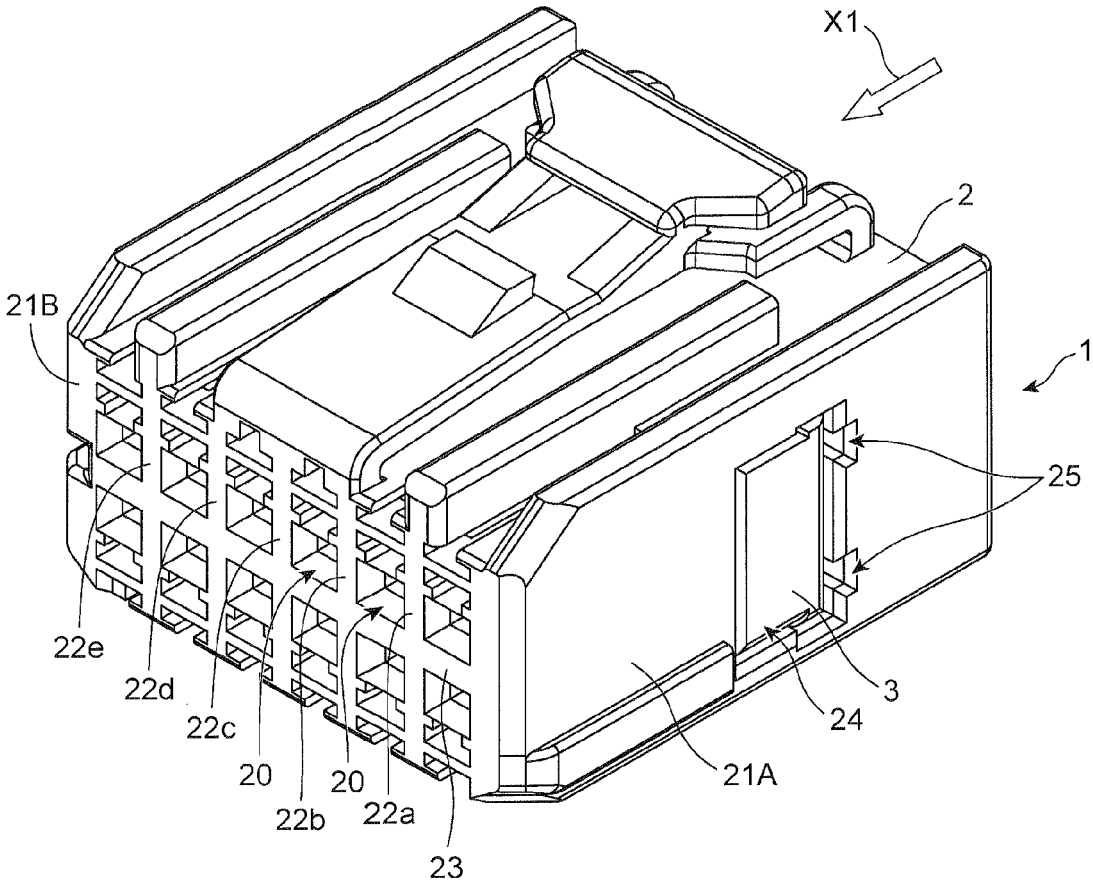
FIG. 1A is a perspective view of an electric connector in accordance with a first embodiment of the present invention, illustrating that a retainer is inserted into a housing.
Figure 1B:
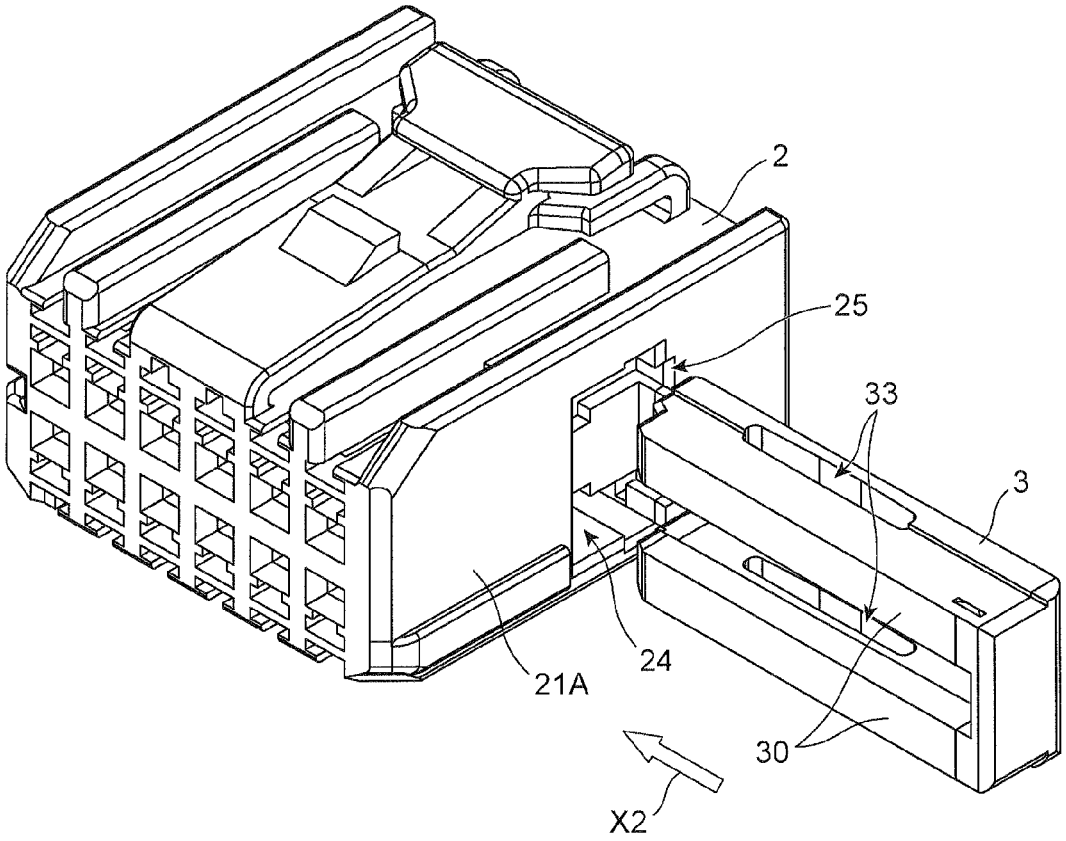
FIG. 1B is a perspective view of the electric connector, illustrating that the retainer is not yet inserted into the housing.
Figure 2A:
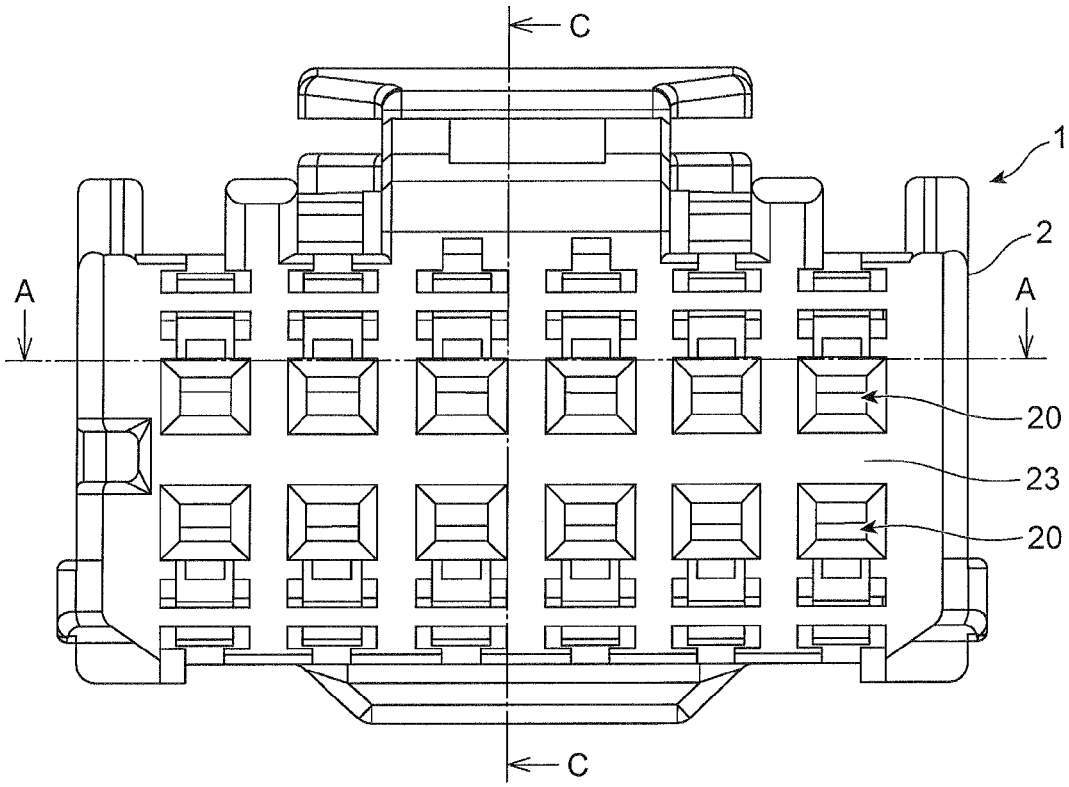
FIG. 2A is a front view of the electric connector illustrated in FIG. 1A.
Figure 2B:
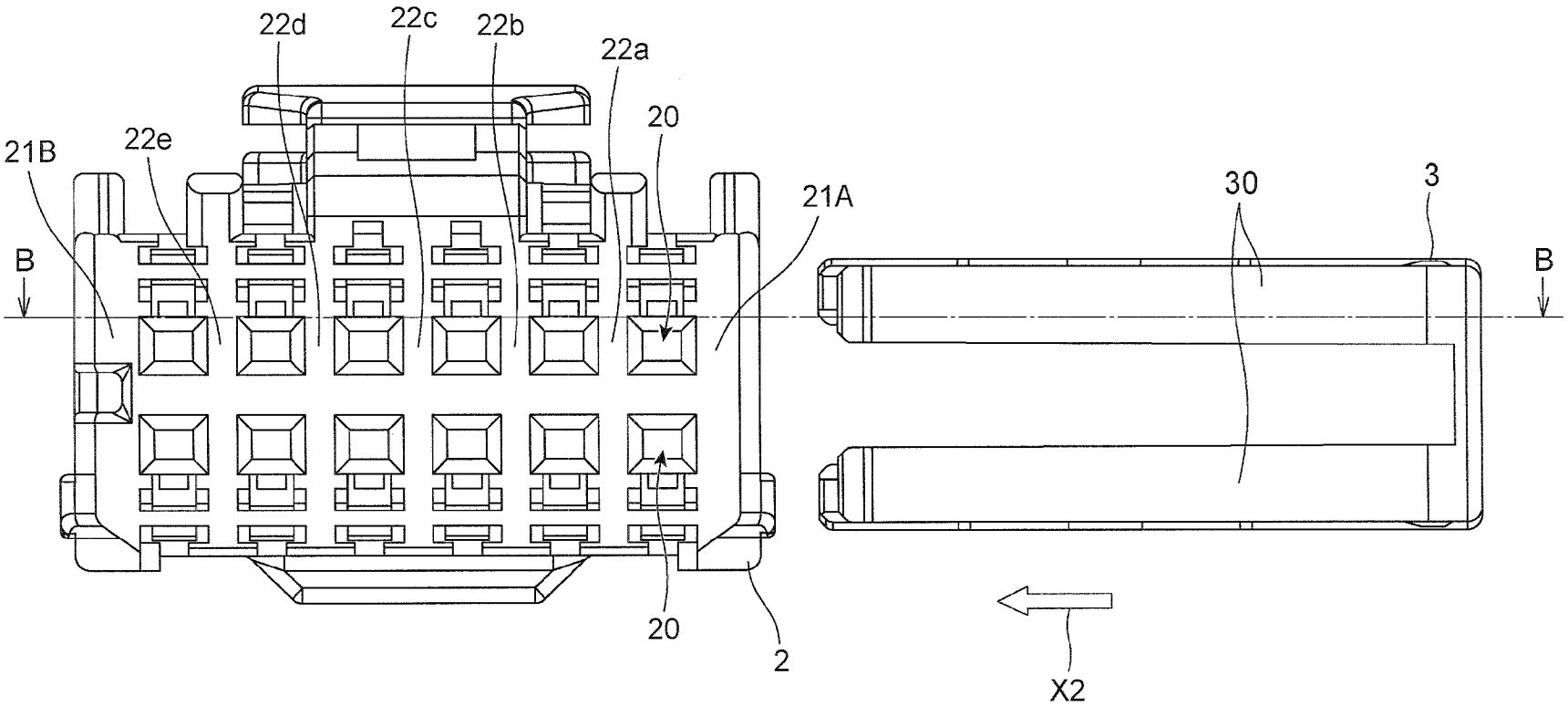
FIG. 2B is a front view of the electric connector illustrated in FIG. 1B.
Figure 3A:
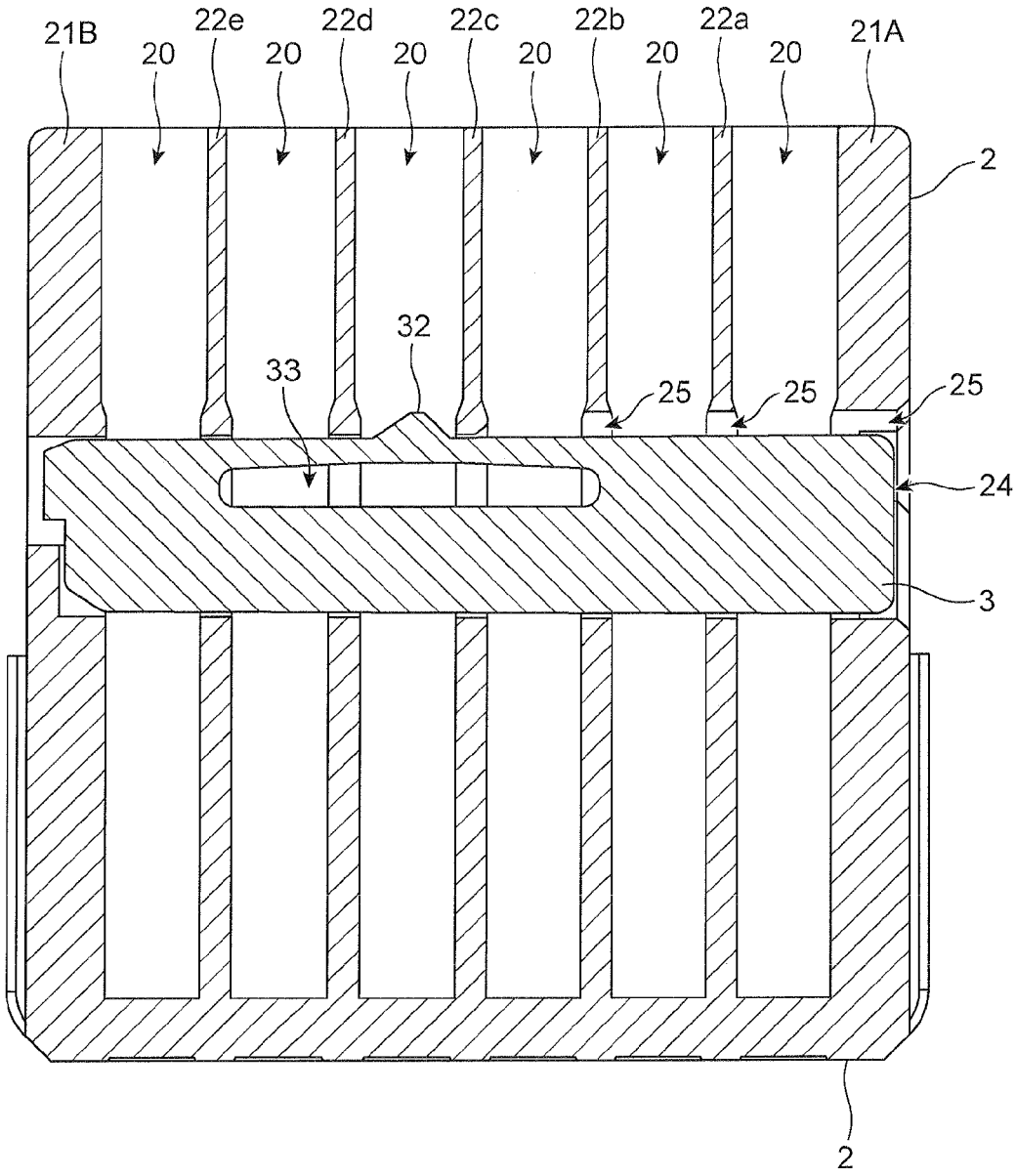
FIG. 3A is a cross-sectional view taken along a line A-A shown in FIG. 2A.
Figure 3B:
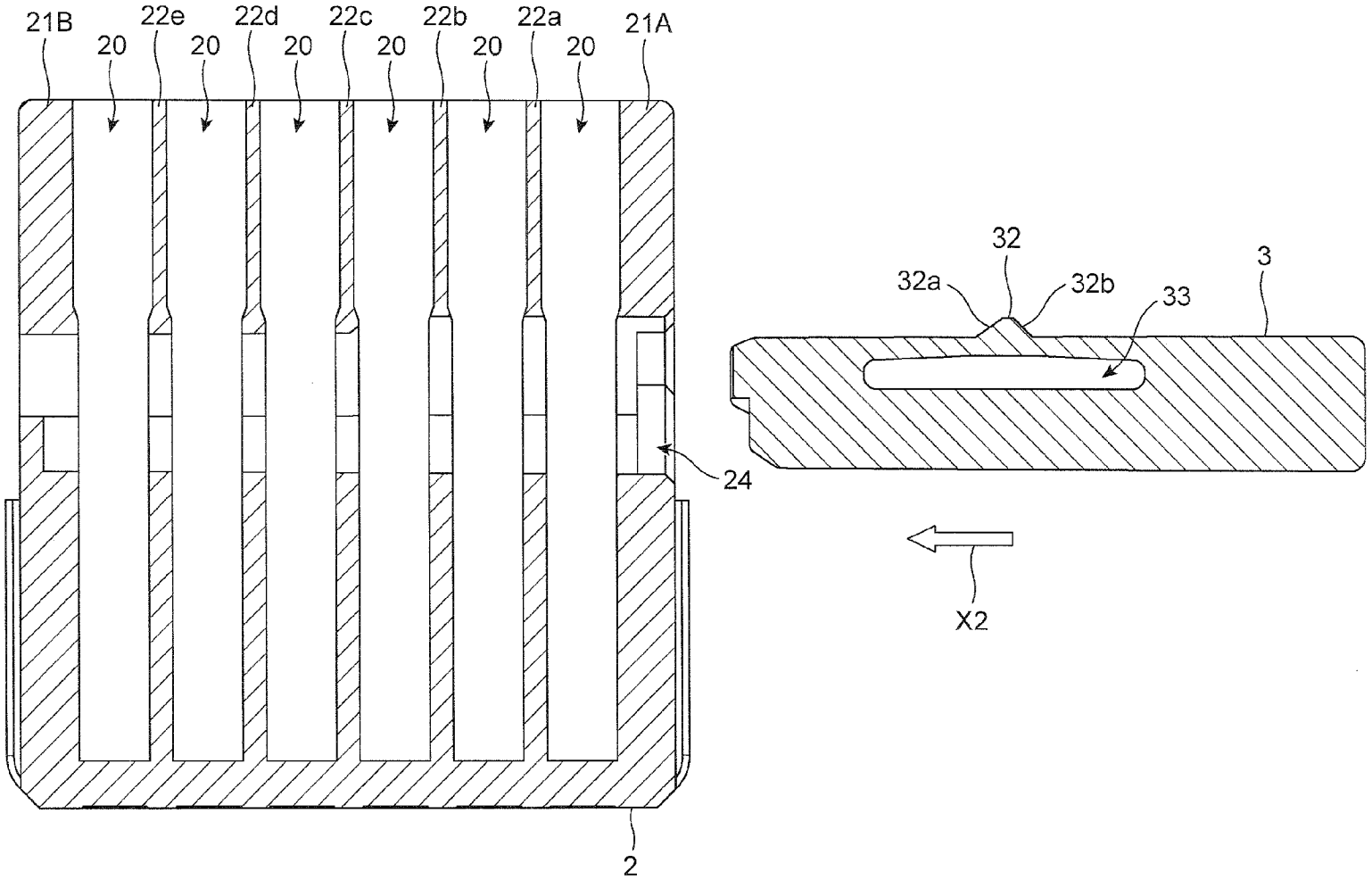
FIG. 3B is a cross-sectional view taken along a line B-B shown in FIG. 2B.
Figure 4A:
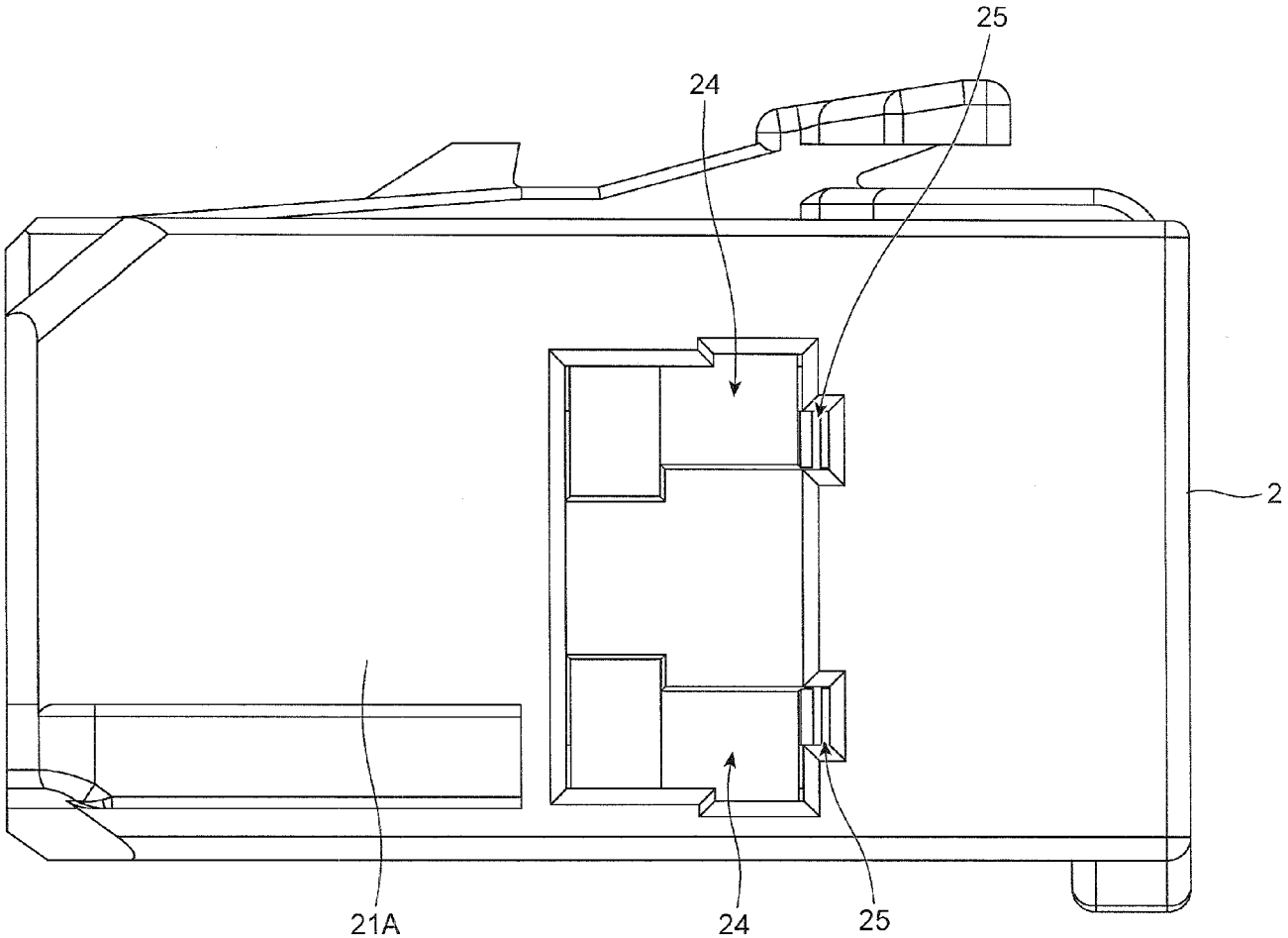
FIG. 4A is a right-side view of the electric connector illustrated in FIG. 1A.
Figure 4B:
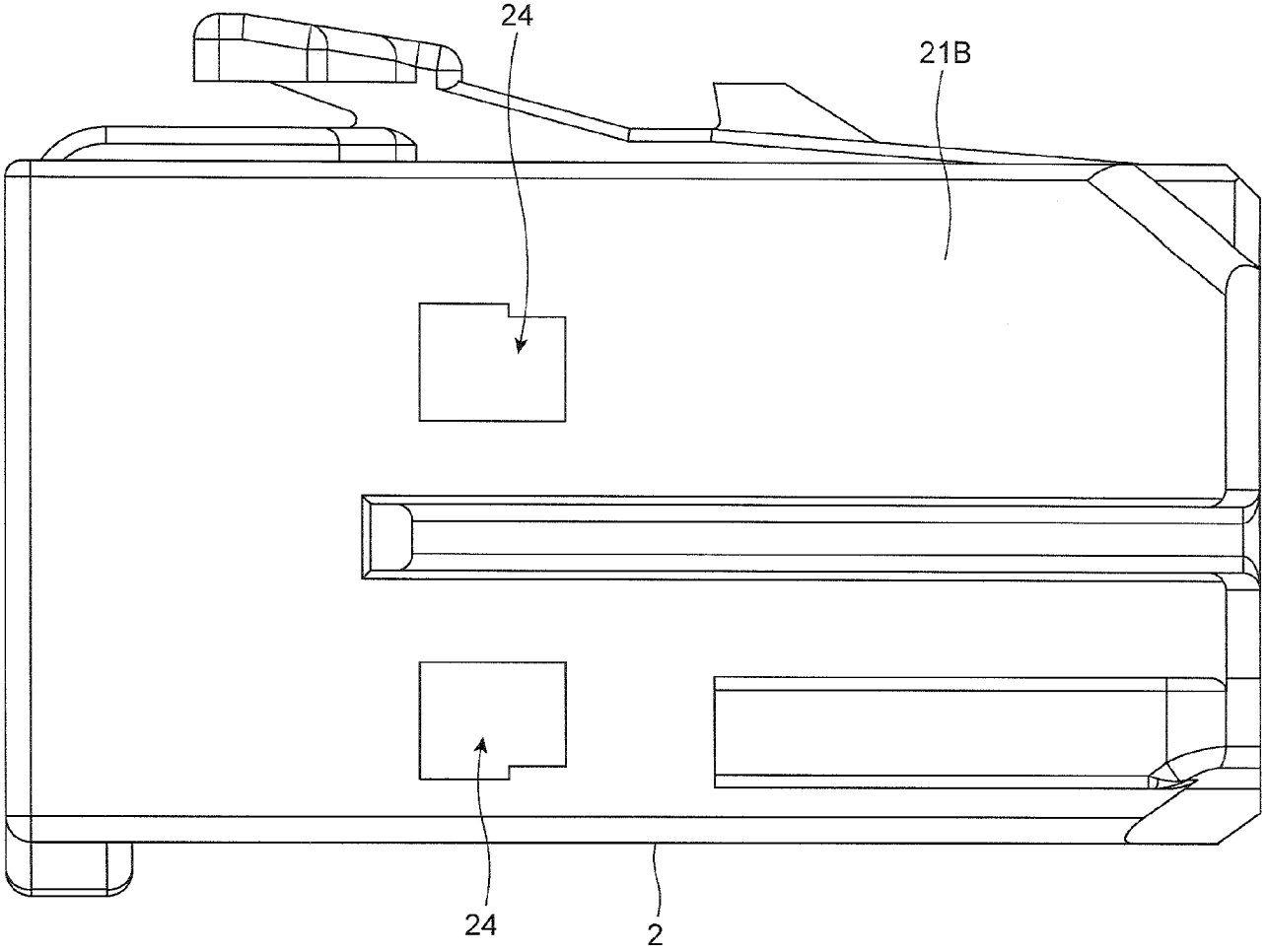
FIG. 4B is a left-side view of the electric connector illustrated in FIG. 1A.
Figure 5:
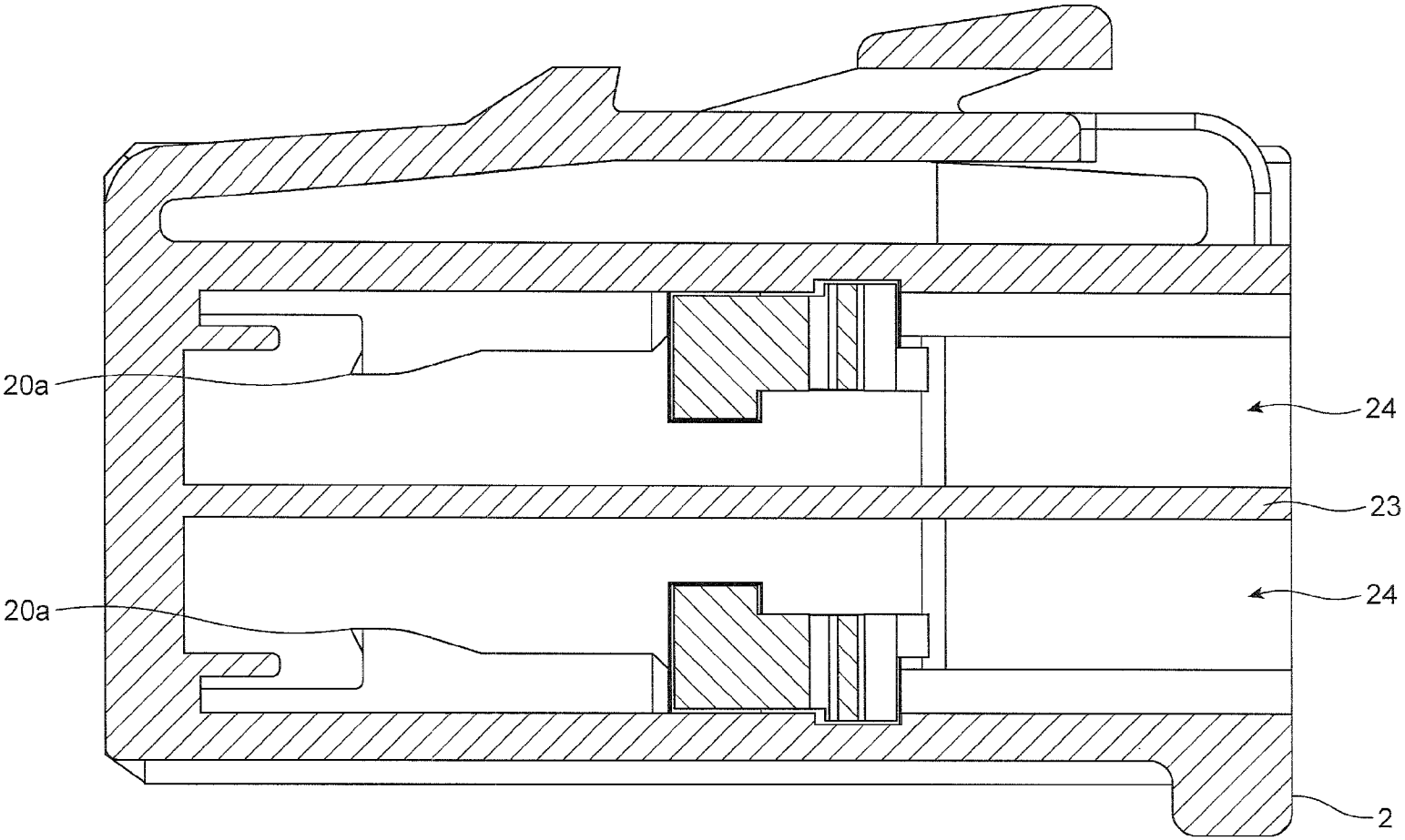
FIG. 5 is a cross-sectional view taken along a line C-C shown in FIG. 2A.
Figure 6:
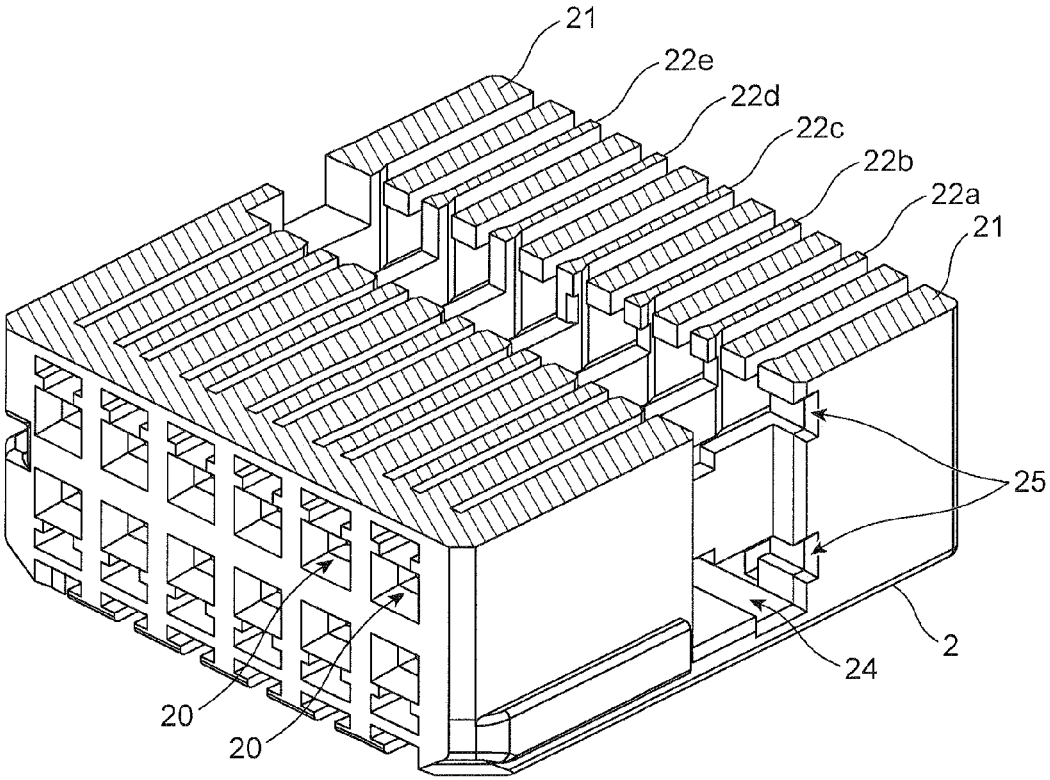
FIG. 6 is a perspective cross-sectional view taken along the line A-A shown in FIG. 2A.
Figure 7:
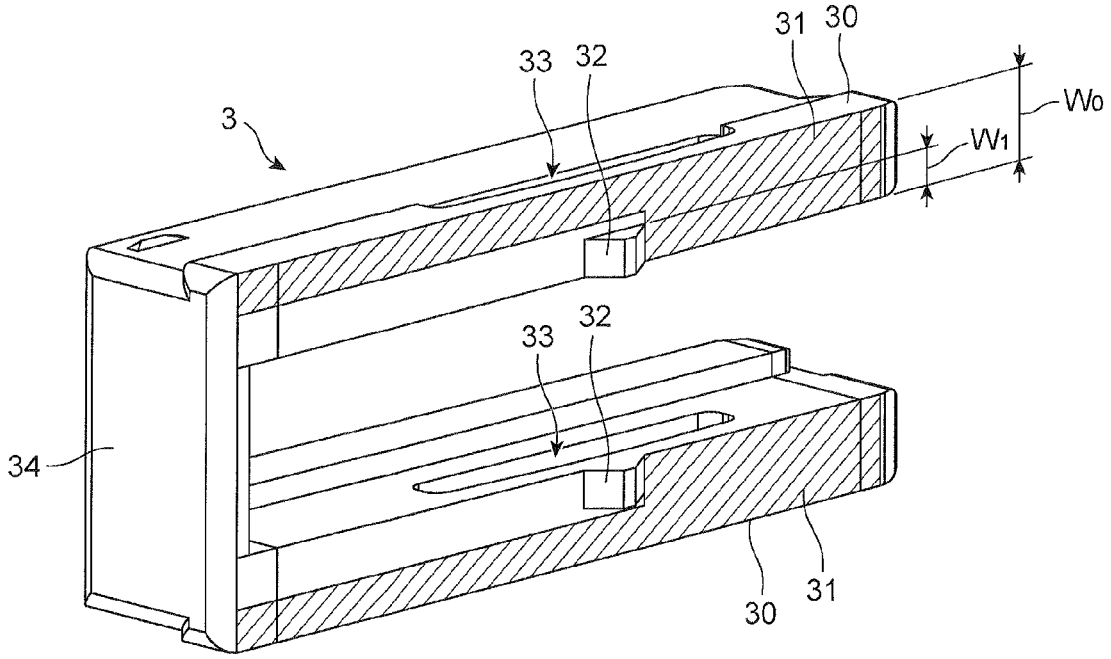
FIG. 7 is a rear perspective view of the retainer illustrated in FIG. 1B.
Figure 8:
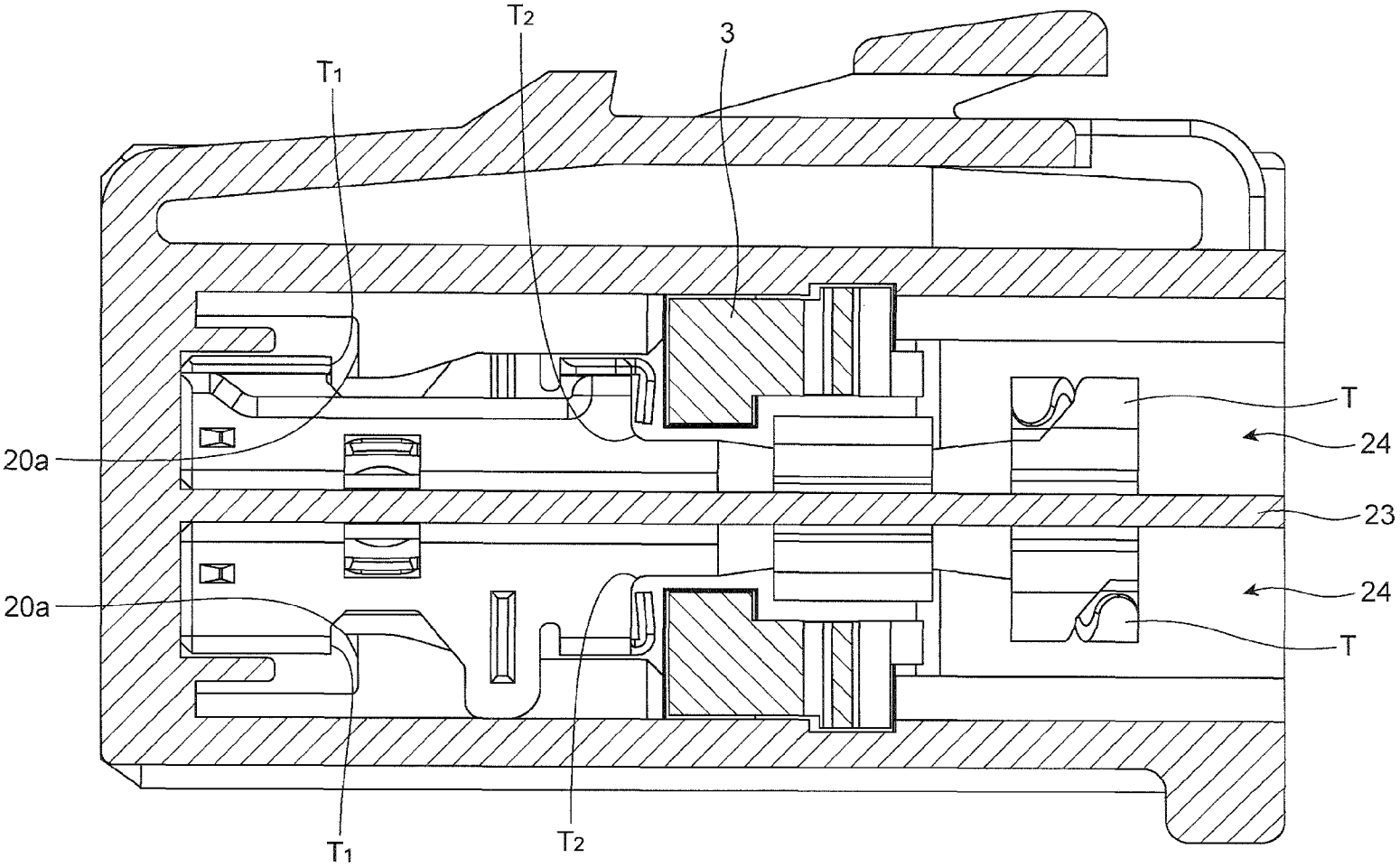
FIG. 8 is a cross-sectional view taken along the line C-C shown in FIG. 2A wherein terminals and the retainer are inserted into the housing.

FIG. 1A is a perspective view of the electric connector in accordance with a first embodiment of the present invention, illustrating that a retainer is inserted into a housing. FIG. 1B is a perspective view of the electric connector, illustrating that the retainer is not yet inserted into the housing. FIG. 2A is a front view of the electric connector illustrated in FIG. 1A. FIG. 2B is a front view of the electric connector illustrated in FIG. 1B. FIG. 3A is a cross-sectional view taken along a line A-A shown in FIG. 2A. FIG. 3B is a cross-sectional view taken along a line B-B shown in FIG. 2B. FIG. 4A is a right-side view of the electric connector illustrated in FIG. 1A. FIG. 4B is a left-side view of the electric connector illustrated in FIG. 1A. FIG. 5 is a cross-sectional view taken along a line C-C shown in FIG. 2A. FIG. 6 is a perspective cross-sectional view taken along the line A-A shown in FIG. 2A. FIG. 7 is a rear perspective view of the retainer illustrated in FIG. 1B. FIG. 8 is a cross-sectional view taken along the line C-C shown in FIG. 2A wherein terminals and the retainer are inserted into the housing.

As illustrated in FIGS. 1A, 1B, 2A and 2B, the electric connector 1 in accordance with the first embodiment includes a housing 2 formed with twelve cavities 20 arranged vertically in two rows into each of which a terminal $T_0$ (see FIG. 8) is inserted, and a retainer 3 inserted into the housing 2 to be secondarily engaged with a second engagement portion $T_2$ (see FIG. 8) of the terminal $T_0$.

The housing 2 and the retainer 3 are made of synthetic resin. The terminal $T_0$ is formed by pressing and/or bending an electrically conductive metal plate. The terminal $T_0$ is inserted into each of the cavities 20 in a direction X1 illustrated in FIG. 1A.

As illustrated in FIGS. 3A and 3B, the cavities 20 are partitioned between sidewalls 21A and 21B of the housing 2 by five partition walls 22*a*, 22*b*, 22*c*, 22*d* and 22*e* and further by a horizontally extending wall 23 (see FIGS. 1A and 5) into vertical two rows. As illustrated in FIGS. 5 and 8, a first engagement section 20*a* is formed in each of the cavities 20. When the terminal $T_0$ is inserted into each of the cavities 20, a first engagement portion $T_1$ of the terminal $T_0$ is engaged with the first engagement section 20*a*.

As illustrated in FIGS. 1A and 1B, the housing 2 is formed at one of the sidewalls 21A with two retainer insertion holes 24 into which the retainer 3 is inserted. As illustrated in FIGS. 3A and 3B, the retainer insertion holes 24 extend through the sidewall 21A and the partition walls 22*a* to 22*e* perpendicularly to the direction X1. As illustrated in FIGS. 4A and 4B, the retainer insertion holes 24 are vertically located on the sidewall 21A.

As illustrated in FIGS. 1B and 7, the retainer 3 includes a base 34, and two arms 30 spaced away from each other and extending from the base 34 in the same direction. Each of the arms 30 is inserted into each of the retainer insertion holes 24 vertically located on the sidewall 21A of the housing 2. Each of the arms 30 includes an abutment surface 31 at which the retainer 3 makes abutment with an inner surface of the retainer insertion hole 24, and a projection 32 projecting over the abutment surface 31 and being engaged with the partition wall 22*c* (see FIG. 3A). In FIG. 7, the abutment surface 31 is illustrated as a hatched area.

As illustrated in FIG. 7, the projection 32 has a width W1 smaller than a width W0 of the abutment surface 31 in a direction perpendicular to a direction X2 in which the retainer 3 is inserted into the retainer insertion hole 24.

As illustrated in FIG. 3A, the projection 32 is formed on the arm 30 at such a location that the projection 32 is engaged with the partition wall 22*c* located centrally of the housing 2 in the direction X2, that is, at a location closer to the sidewall 21B than a center of the retainer 3 in the direction X2.

Each of the arms 30 of the retainer 3 is formed with a through-hole 33 below the projection 32 in the direction X1. The through-hole 33 is formed through the width W0 of the arm 30, and extends in the direction X2. Specifically, the projection 32 is located within a length of the through-hole 33. The through-hole 33 allows the projection 32 to be elastically deformable when the projection 32 makes abutment with the partition wall 22*c*. Specifically, the projection 32 can elastically sink relatively to the partition wall 22*c* to thereby pass over the partition wall 22*c*, and thereafter, the projection 32 elastically returns back to its original position to thereby be engaged with the partition wall 22*c*.

As illustrated in FIG. 3B, the projection 32 has two inclining surfaces 32*a* and 32*b*. The inclining surface 32*a* descends in the direction X2, and the inclining surface 32*b* ascends in the direction X2. The inclining surfaces 32*a* and 32*b* convert a force that pushes the retainer 3 in the direction X2 when the retainer 3 is inserted into the retainer insertion hole 24, into a force that pushes the projection 32 towards the through-hole 33, ensuring that the projection 32 is elastically deformable.

As illustrated in FIGS. 3A and 6, the partition walls located in the direction X2 to the rear of the partition wall 22*c* with which the projection 32 is engaged, that is, the partition walls 22*a* and 22*b* are formed with a cut-out 25 such that the projection 32 can pass through the retainer insertion hole 24 without interfering with the partition walls 22*a* and 22*b*. The sidewall 21A is also formed with a cut-out 25 in alignment with the cut-outs 25 of the partition walls 22*a* and 22*b*. The cut-outs 25 are designed to have such a size that when the retainer 3 is inserted into the retainer insertion hole 24, the projection 32 does not make contact with the partition walls 22*a* and 22*b* to thereby be able to pass over the partition walls 22*a* and 22*b* without being elastically deformed, or that even if the projection 32 makes contact with the partition walls 22*a* and 22*b*, the projection 32 can pass over the partition walls 22*a* and 22*b* without pushing the retainer 3 with an intensive force.

In the electric connector 1 having the above-mentioned structure, when the terminal $T_0$ is inserted into each of the cavities 20 of the housing 2, the first engagement portion $T_1$ of the terminal $T_0$ is engaged with the first engagement section 20*a* of the cavity 20. Then, the retainer 3 acting as a secondary engagement tool is inserted into the retainer insertion hole 24. Thus, the terminal $T_0$ inserted into each of the cavities 20 is stably held in each of the cavities 20, because the first and second engagement portions $T_1$ and $T_2$ are engaged with the first engagement section 20*a* of the housing 2 and the retainer 3, respectively. That is, the terminal $T_0$ is doubly engaged with the housing 2 in each of the cavities 20.

When the retainer 3 is inserted into the retainer insertion hole 24, the projection 32 of the retainer 3 passes over the cut-outs 25 formed at the sidewall 21A and the partition walls 22*a* and 22*b* located closer to the sidewall 21A than the partition wall 22*c* with which the projection 32 is engaged. Accordingly, the retainer 3 can smoothly pass through the retainer insertion hole 24 until the projection 32 reaches the partition wall 22*c*.

When the projection 32 reaches the partition wall 22*c*, the projection 32 is elastically deformed by the partition wall 22*c*, that is, the partition wall 22*c* sinks in the direction X1 relative to the partition wall 22*c* to thereby pass over the partition wall 22*c*. After passing over the partition wall 22*c*, the projection 32 elastically deforms to return back to its original position to thereby be engaged with the partition wall 22*c*.

When the retainer 3 is to be released out of the housing 2, the retainer 3 is pushed from the sidewall 21B in a direction opposite to the direction X2. As a result, the projection 32 is elastically deformed by the partition wall 22*c*, that is, the projection 32 sinks relative to the partition wall 22*c* to thereby pass over the partition wall 22*c* in a direction opposite to the direction X2. After passing over the partition wall 22*c*, the projection 32 elastically deforms to return back to its original position. Thereafter, since the projection 32 passes over the cut-outs 25 of the partition walls 22*a* and 22*b* and the sidewall 21A, the retainer 3 can be smoothly taken out of the housing 2.

The retainer 3 inserted into the retainer insertion hole 24 makes abutment with an inner surface of the retainer insertion hole 24 through the abutment surface 31 in a broad area. Thus, even if an external force causing the terminal $T_0$ to be released out of the housing 2 acts on the terminal $T_0$, the abutment surface 31 receives the force to cancel the force, providing high reliability in preventing the terminals $T_0$ from being released out of the housing 2.

The retainer 3 in the first embodiment is designed to include the through-hole 33 allowing the projection 32 to elastically deform. This ensures that even though the retainer 3 is simple in shape, the projection 32 can elastically deform to thereby pass over the partition wall 22*c* and be engaged with the partition wall 22*c*, without complexity in a configuration of the retainer 3.

The projection 32 is designed to be engaged with the partition wall 22*c* located centrally among the partition walls 22*a* to 22*e* in the direction X2. Thus, the retainer 3 is required to elastically deform at a center thereof to allow the projection 32 to pass over the partition wall 22*c*. Hence, it is possible to design the retainer 3 to elastically deform at a center to thereby enhance a strength of the retainer 3. It should be noted that the projection 32 may be designed to be engaged with the partition wall 22*b* or 22*d* located almost centrally of the housing 2, in which case, it is also possible to enhance a strength of the retainer 3.

In the first embodiment, the retainer 3 is designed to be elastically deformable such that the projection 2 can pass over the partition wall 22*c* to thereby be engaged with the partition wall 22*c*. Accordingly, when the retainer 3 is inserted into the retainer insertion hole 24, the projection 32, after having passed the cut-outs 25 of the sidewall 21A and the partition walls 22*a* and 22*b*, can be engaged with the partition wall 22*c* merely by passing over the partition wall 22*c*. This ensures that the retainer 3 can be readily inserted into and released out of the housing 2.

The housing 2 in the first embodiment is designed to have the five partition walls 22*a* to 22*e*. The number of the partition walls is not to be limited to five. Any number other than five may be selected.

In the first embodiment, the cavities 20 are arranged vertically in two rows. As an alternative, the cavities 20 may be arranged in a row or vertically three or more rows. In accordance with the number of vertical rows of the cavities 20, the retainer 3 may be designed to have the arms 30 in the same number as the number of the vertical rows of the cavities 20. As an alternative, a plurality of retainers each having a single arm 30 may be used. For instance, three retainers are used for vertical three rows of the cavities 20. A single retainer having N arms may be used for vertical N rows of the cavities 20, wherein N indicates an integer equal to or greater than 2.

As illustrated in FIG. 3A, the projection 32 is designed to have a trapezoidal cross-section. The projection 32 may be designed to have a triangular cross-section. As an alternative, the projection 32 may be designed to have a semicircular cross-section.

The retainer 3 in the first embodiment is designed to include a single projection 32. The retainer 3 may be designed to include two or more projections 32.

Second Embodiment

Figure 9:
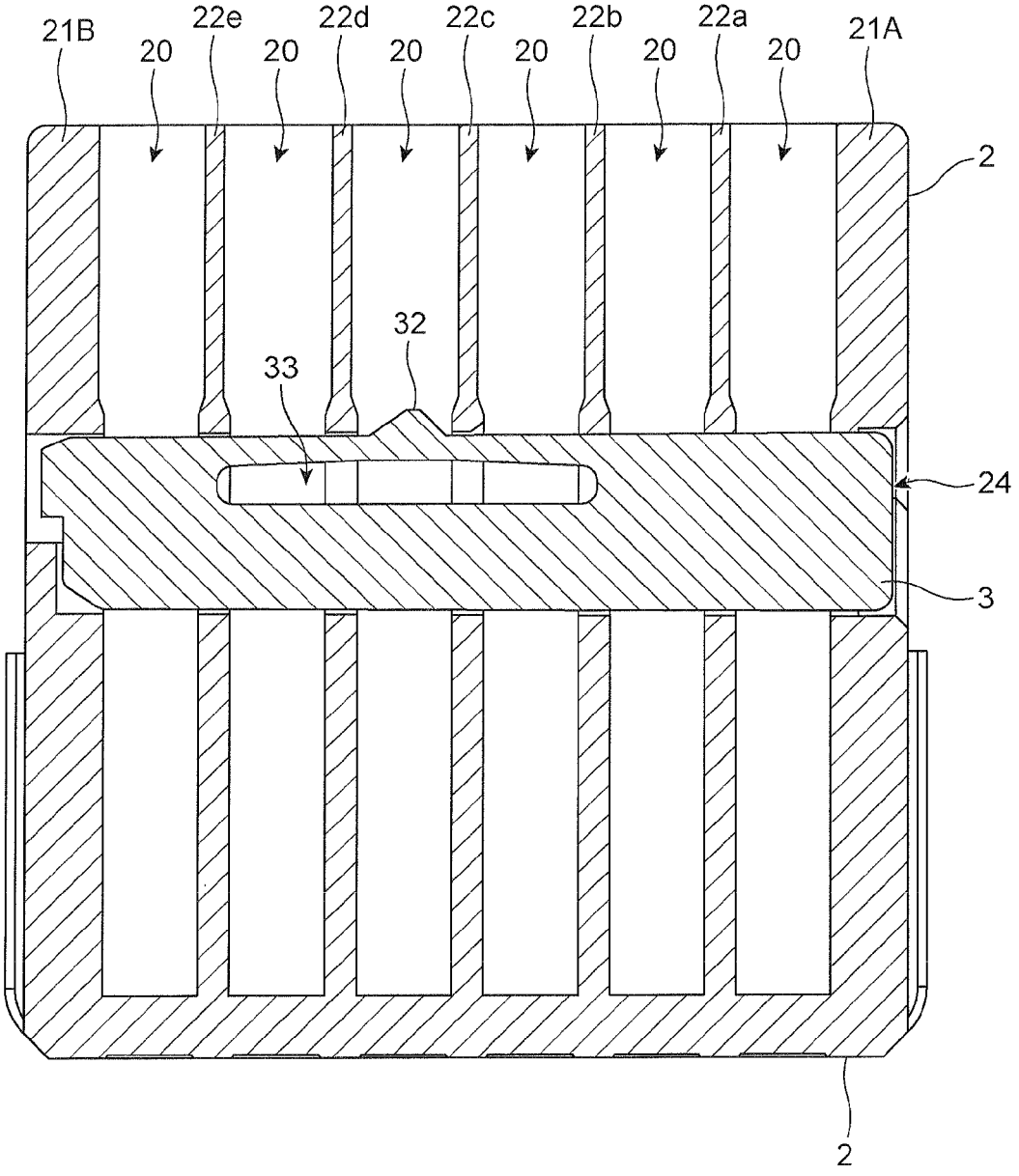
FIG. 9 is a cross-sectional view of the electric connector in accordance with a second embodiment of the present invention.
Figure 10:
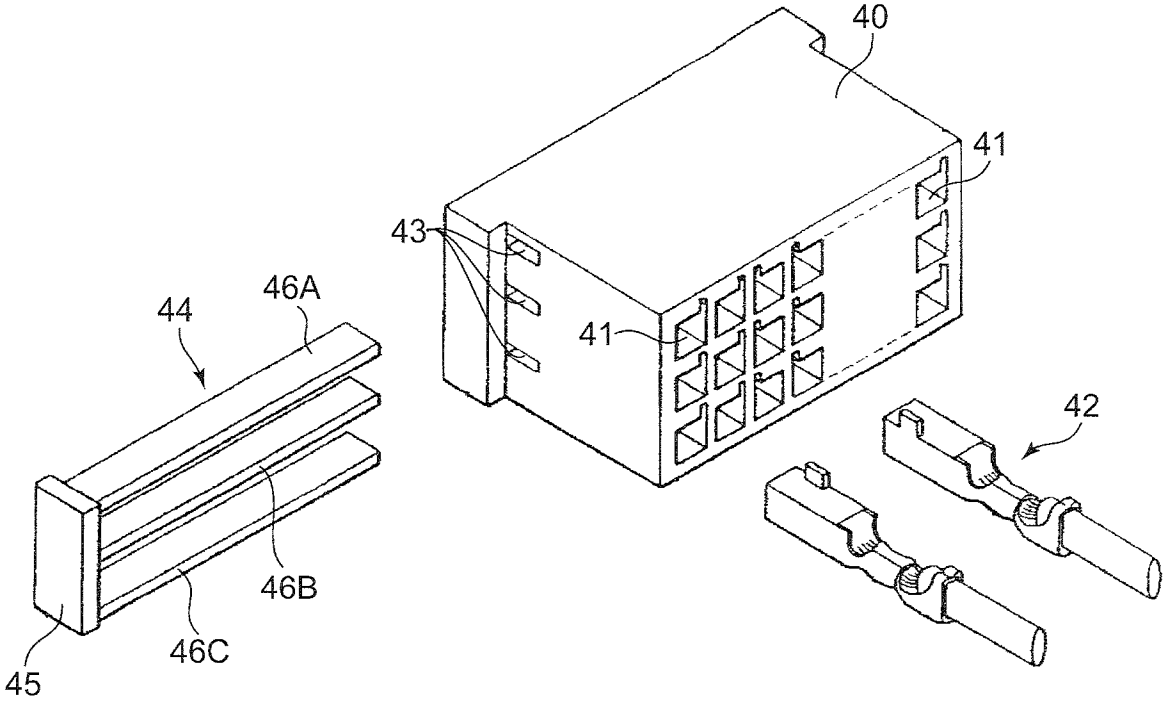
FIG. 10 is a perspective view of a conventional electric connector.
Figure 11:
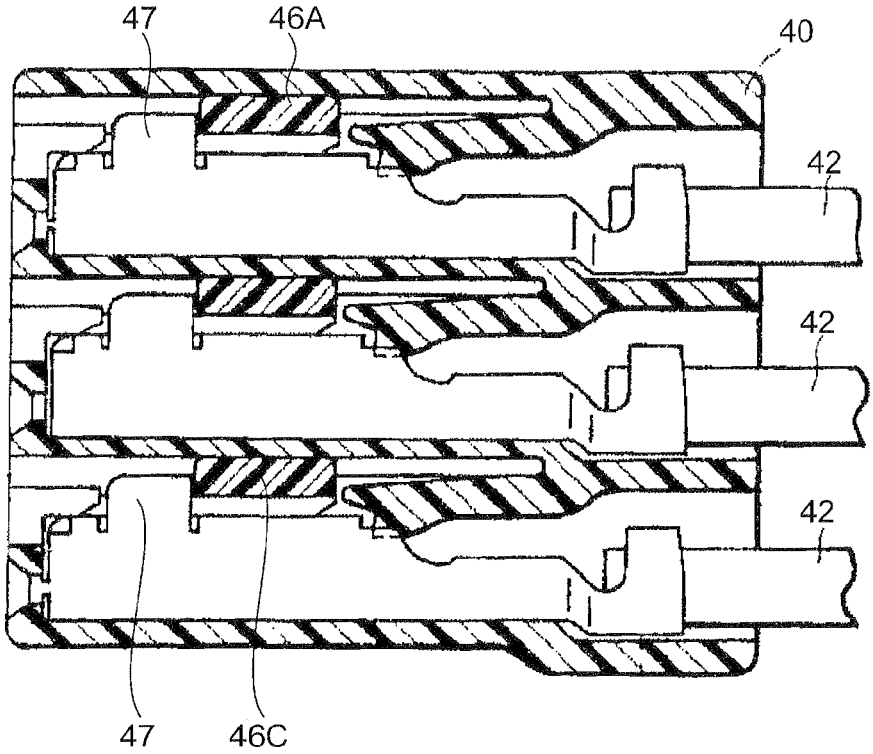
FIG. 11 is a cross-sectional view of the conventional electric connector illustrated in FIG. 10.
Figure 12:
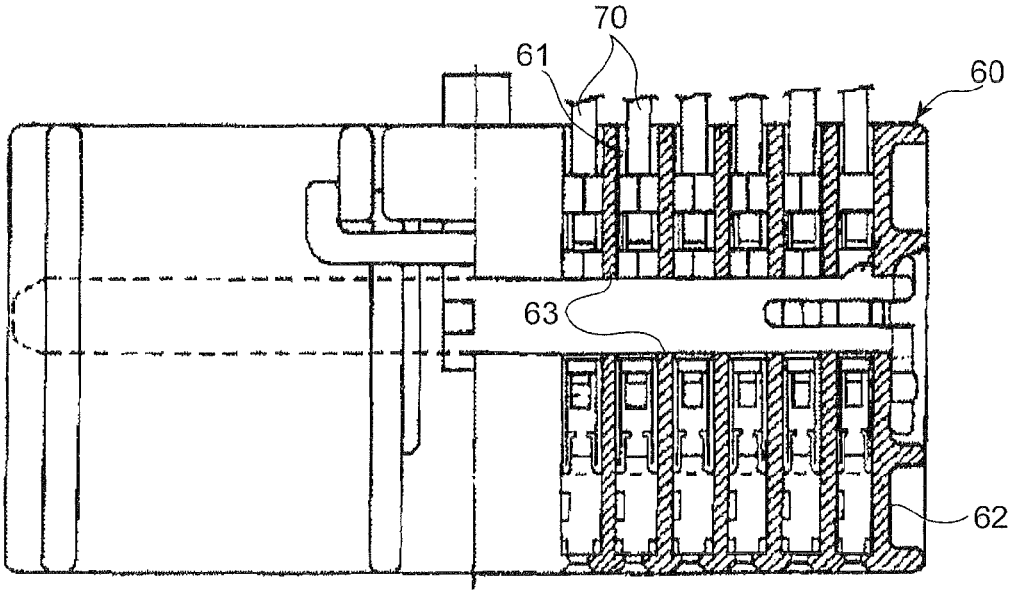
FIG. 12 is a cross-sectional view of a second conventional electric connector.
Figure 13:
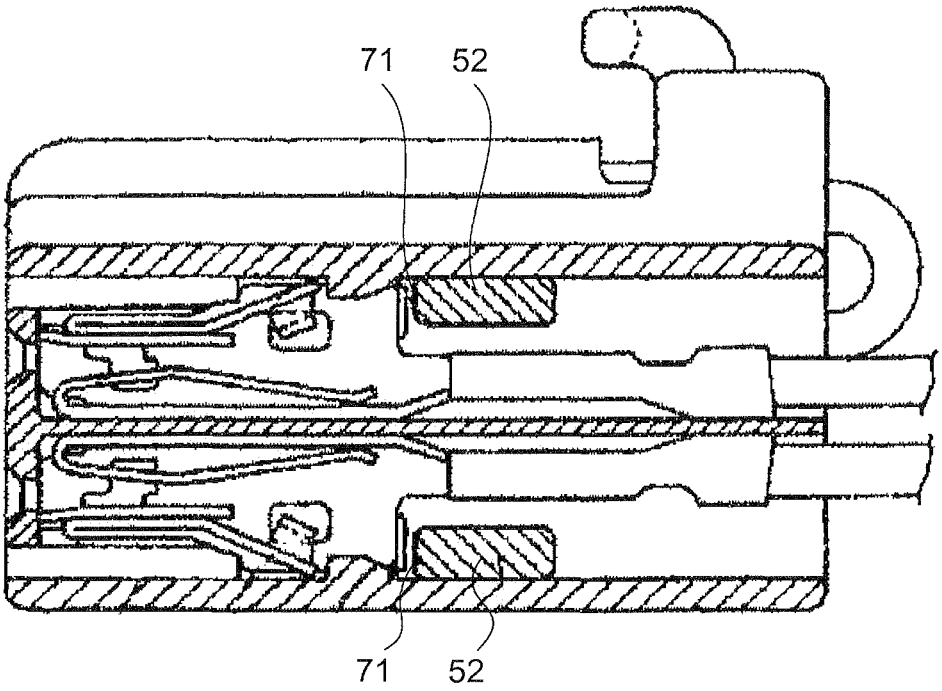
FIG. 13 is a partial cross-sectional view of the electric connector illustrated in FIG. 12.
Figure 14:
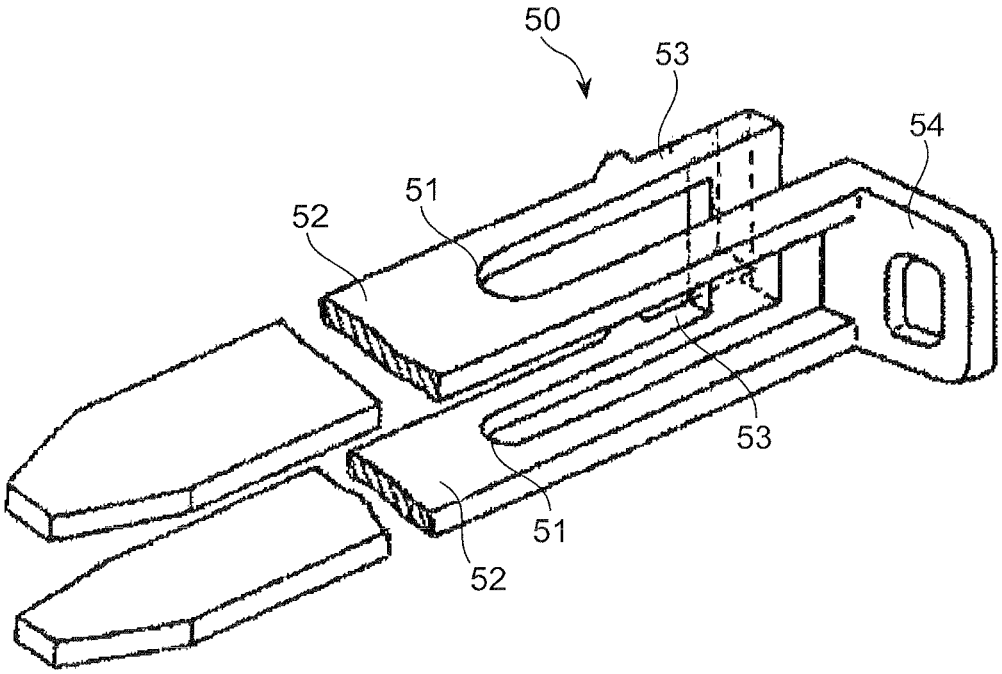
FIG. 14 is a perspective view of a retainer used for the electric connector illustrated in FIG. 12.

FIG. 9 is a cross-sectional view of the electric connector in accordance with a second embodiment of the present invention, similarly to FIG. 3A.

The partition walls 22*a* and 22*b* and the sidewall 21A in the first embodiment are formed with the cut-outs 25, as illustrated in FIG. 3A. In contrast, the partition walls 22*a* and 22*b* and the sidewall 21A in the second embodiment are formed without the cut-outs 25, as illustrated in FIG. 9.

Parts or elements that correspond to those of the electric connector 1 in accordance with the first embodiment except the partition walls 22*a* and 22*b* and the sidewall 21A are provided with the same reference numerals, and operate in the same manner as corresponding parts or elements in the first embodiment, unless explicitly explained hereinbelow.

In the second embodiment, the projection 32 is caused to be elastically deformed downwardly by the partition wall 22*a* to thereby pass over the partition wall 22*a*. Then, the projection 32 passes over the partition walls 22*b* and 22*c* in the same way. After having passed over the partition wall 22*c*, the projection 32 is engaged with the partition wall 22*c*.

Even if the projection 32 returns back over the partition wall 22*c* in a direction opposite to the direction X2, the projection 32 is engaged with the partition wall 22*b* located adjacent to the partition wall 22*c*. Accordingly, the retainer 3 is prevented from being pulled out of the housing 2. In the case that the projection 32 is engaged with the partition wall 22*b*, since the retainer 3 is in a condition of extending outwardly over the sidewall 21A of the housing 2, it is readily seen that the retainer 3 returned back over the partition wall 22*c* and was engaged with the partition wall 22*b*.

INDUSTRIAL APPLICABILITY

The electric connector in accordance with the present invention is useful as an electric connector to be used for electrical connection between devices equipped in an automobile or various industrial machines.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-003681 filed on Jan. 10, 2014 including specification, claims, drawings and summary is incorporated herein by reference in its entirety.

What is claimed is:

1. An electric connector including:

a housing including a plurality of partition walls and having a plurality of cavities partitioned said partition walls, a terminal being inserted into each of said cavities, said housing being formed with at least one retainer insertion hole formed through a sidewall of said housing and said partition walls in a second direction perpendicular to a first direction in which said terminal is inserted into each of said cavities; and a retainer for inserting into said retainer insertion hole for engagement with said terminal in said housing, said retainer including:

a surface with which said retainer makes contact with said retainer insertion hole, and at least one projection formed on said surface, said projection passing over at least one partition wall among said partition walls, and being engaged with a particular partition wall among said partition walls, said projection being elastically deformable in said first direction said partition walls situated in said second direction to the rear of the partition walls with which said projection is engaged, being formed with a cut-out such that said partition walls do not block said projection passing through said retainer insertion hole when said retainer is inserted into said retainer insertion hole, said surface of said retainer making contact with a sidewall of said retainer insertion hole and further with one of more sidewall(s) of said cavities, said projection partially defining a width of said retainer in a direction perpendicular to said second direction.

2. The electric connector as set forth in claim 1, wherein said retainer is formed with a through-hole extending in a direction perpendicular to said first direction below said projection in said first direction, said through-hole allowing said projection to be elastically deformable.

3. The electric connector as set forth in claim 1, wherein said housing is formed with N retainer insertion holes, N indicating an integer equal to or greater than 2, said retainer including:

a base; and

N arms extending from said base in the same direction.

4. The electric connector as set forth in claim 1, wherein said projection includes two surfaces inclining in said second direction.

5. The electric connector as set forth in claim 1, wherein said projection has a semicircular cross-section.

6. The electric connector as set forth in claim 1, wherein said projection is engaged with one of said partition walls situated centrally' in said second direction or one of said partition walls situated in the vicinity of a center in said second direction.

7. The electric connector as set forth in claim 1, wherein said projection is engaged, after passing over a certain partition wall among said partition walls, with said certain partition wall.

8. The electric connector as set forth in claim 1, wherein said projection is engaged, after passing over partition walls among said partition walls, with a partition wall over which said projection finally passed.

* * * * *